United States Patent [19]

Ritten

[11] Patent Number: 4,735,285

[45] Date of Patent: Apr. 5, 1988

[54] BOAT LADDERS WITH SLIDE-OUT STEP

[75] Inventor: Robert G. Ritten, Ft. Pierce, Fla.

[73] Assignee: Step-On Inc., Ft. Pierce, Fla.

[21] Appl. No.: 86,483

[22] Filed: Aug. 18, 1987

[51] Int. Cl.[4] ..... B63B 27/14; B63B 29/20

[52] U.S. Cl. ..... 182/83; 182/84; 182/91; 182/88; 114/362; 280/166

[58] Field of Search ..... 182/88, 84, 90, 91, 182/83; 280/166, 163; 114/362

[56] References Cited

U.S. PATENT DOCUMENTS

| | | | |
|---|---|---|---|
| 2,809,849 | 10/1957 | Benne | 182/91 |
| 2,956,638 | 10/1960 | Bustin | 182/88 |
| 2,971,600 | 2/1961 | Schultz | 182/88 |
| 3,195,680 | 7/1965 | Thornburg | 182/92 |
| 3,452,838 | 7/1969 | Gabrielson | 182/195 |
| 3,756,622 | 9/1973 | Pyle | 280/166 |
| 3,774,720 | 11/1973 | Hovey | 182/91 |
| 3,817,554 | 6/1974 | Cuffe | 182/88 |
| 3,826,337 | 7/1974 | Liptak | 182/88 |
| 4,462,485 | 7/1984 | Terry | 182/91 |

*Primary Examiner*—Reinaldo P. Machado
*Attorney, Agent, or Firm*—Carroll F. Palmer

[57] ABSTRACT

A ladder device for the transom of a boat has a platform unit and a step unit that may be moved between a use position with a step thereof immersed in the water in which the boat floats and a storage position where the step is located out of the water. The step in the use position extends aft of the platform unit and permits a person to climb out of the water and onto the platform unit without the step making any appreciable movement relative to the platform unit during such climb. The platform unit includes a pair of ring members that each depends from a respective longitudinal section of the unit. The step unit includes a U-shaped tubular member defined by two parallel side sections joined integrally to a transverse section. The side sections each have a long leg and a short leg with one end thereof unattached and a stop member is carried on such unattached end. The U-shaped tubular member is formed from tubing having an outside diameter slightly less than the inside diameter of the ring member whereby the side sections may be moved through the ring member to move the step unit from the storage position to the use position wherein the short legs are positioned in the ring members and the transverse section is positioned aft and below the ring members to serve as a step for the ladder device.

15 Claims, 2 Drawing Sheets

BOAT LADDERS WITH SLIDE-OUT STEP

BACKGROUND OF THE INVENTION

1. Field of the Invention

This invention relates broadly to boarding devices for boats. More particularly, it concerns ladder devices for the transom of boats having a platform unit and a step unit that may be moved between a use position with a step thereof immersed in the water in which the boat floats and a storage position where the step is located out of the water, which step when in the use position extends aft of the platform unit and permits a person to climb out of the water and onto the platform unit without the step making any appreciable movement relative to the platform unit during such climb.

2. Description of the Prior Art

A variety of platform and step devices have been developed and marketed for attachment to the transoms of boats to assist in boarding or debarking the boats or to help in moving or working about the stern of the boats. These prior devices can be divided broadly into three classes, i.e,. (1) those that are strictly ladders and provide no real platform function (see U.S. Pat. No. 3,774,720), (2) those that are strictly platforms and (3) those that provide combination step and platform functions (see U.S. Pat. Nos. 3,195,680 and 4,462,485). The present invention relates the devices of the third type.

In the devices of the third type in the prior art there is typically a platform that attaches to the boat transom plus some form of depending step arrangement that assists the user of the device to lower or raise his body upon one or more steps positioned at a level below the platform. In some forms of such devices, the depending step or steps are fixed immoveably to the platform while in others the step or steps are hinged or otherwise arranged to move between a lowered, use position and a raised, storage position. The present invention concerns boat ladder devices of the moveable step type.

The prior art devices of the type to which the present invention relates as stated above have some undesirable aspects. For example, many such type prior art devices have a moveably step section mounted to the platform section in a manner that the step section is not sturdily fixed when in the lowered, use position with the result that the user has a difficulty in lifting his body on an unsteady step. This is particularly bothersome when the user is carrying heavy gear, e.g., scuba gear, since the added weight serves to aggravate the unstable conditions. The present invention provides a solution to this type of boat step problem.

OBJECTS

A principal object of the invention is the provision of improved forms of ladder devices for attachment to transoms of boats.

Further objects include the provision of:

1. Ladder devices for boats having moveable step sections in which the step section when in the lowered, use position is fixed against swinging or other movement relative to the platform to which attached so a user is presented with steady step or steps upon which to lift his body and any gear that he carries.

2. New boat ladder devices having improved safety and function features.

3. Such devices structured to minimize material and labor costs in their manufacture.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The objects are accomplished, in part, in accordance with the invention by the provision of ladder devices for the transom of a boat that comprise a platform unit and a step unit that may be moved between a use position with a step thereof immersed in the water in which the boat floats and a storage position where the step is located out of the water, which step in the use position extends aft of the platform unit and permits a person to climb out of the water and onto the platform unit without the step making any appreciable movement relative to the platform unit during such climb.

The platform unit comprises a pair of parallel, longitudinal sections that in the use position of the ladder device extend substantially horizontally aft of the transom and a ring member that depends from each of the longitudinal sections.

The step unit comprises a U-shaped tubular member defined by two parallel side sections both joined integrally to a transverse section. The side sections each includes a long leg attached at one end to the transverse section and attached at the other end to a short leg leaving one end of the short leg unattached with the longitudinal axis of the short leg is at an obtuse angle to the longitudinal axis of the long leg.

There is stop means on the unattached end of each of the short legs to limit movement of the step unit into the use position.

The U-shaped tubular member is formed from tubing having an outside diameter slightly less than the inside diameter of the ring member so the side sections of the U-shaped tubular member may be moved through the ring member to move the step unit from the storage position wherein the long legs are adjacent and parallel to the longitudinal sections to the use position wherein the short legs are positioned in the ring members and the transverse section is positioned aft and below the ring members to serve as a step for the ladder device.

Several embodiments of the new ladder devices are disclosed, one in which the device includes its own stern platform and another in which the device attaches to a stern platform already installed on a boat.

BRIEF DESCRIPTION OF THE DRAWINGS

A more complete understanding of the invention may be had by reference to the accompanying drawing in which.

DESCRIPTION OF THE PREFERRED EMBODIMENT

Figure 1:
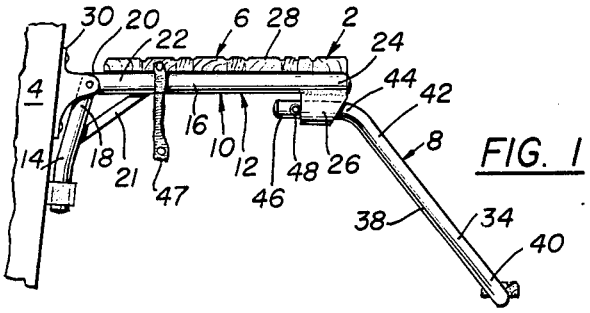
FIG. 1 is lateral view of a first embodiment of a ladder device in accordance with the invention with its step unit lowered into the use position.
Figure 2:
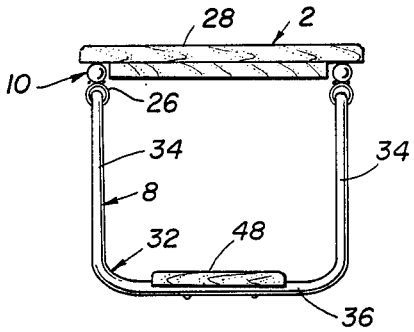
FIG. 2 is a end view of the ladder device of FIG. 1.

Referring in detail to the drawings, in which identical parts are identically marked, the invention provides a ladder device 2 for the transom 4 of a boat formed basically of a platform unit 6 and a step unit 8.

The platform unit 6 has a tubular unit 10 which includes a pair of spaced apart, L-shaped tubular members 12 having an inboard section 14 and a longitudinal section 16.

The inboard section 14 is a length of tubing attached at one end 18 to the longitudinal section 16 by a substantially right angle elbow 20.

A bar 21 is fixed across from the inboard section 14 to the section 16 to act as a brace for the section 16.

The longitudinal section 16 is a length of tubing having a first end 22 attached to the inboard section 14 and second unattached end 24.

A ring member 26 depends from each longitudinal section 16 at the unattached end 24 and planking 28 is attached to each longitudinal section 16 of the tubular unit 10 holding them spaced apart and with the inboard sections 14 extending away from the planking 28.

In the use position of the device 2, the longitudinal sections 16 extend substantially horizontally aft of the transom, but the platform unit may be pivoted on the saddle brackets 30 into a position (not shown) where the sections 16 extend vertically.

The step unit 8 comprises a U-shaped tubular member 32 defined by two parallel side sections 34 joined integrally to a transverse section 36.

The side sections 34 each includes a long leg 38 attached at one end 40 to the transverse section 36 and attached at the other end 42 to a short leg 44 having one end 46 of the short leg unattached. The longitudinal axis of the short leg 44 is at an obtuse angle to the longitudinal axis of the long leg 38.

Lugs 48 extend normally from the unattached end 46 of each short leg 44 to serves as stop means to limit the extent to which the step unit can depend from the ring members 26 and prevent the step unit 8 from exiting the ring members 26.

The U-shaped tubular member 32 is formed from tubing having an outside diameter slightly less than the inside diameter of the ring members 26 whereby the side sections 34 may be moved through the ring membres 26 to move the step unit 8 from the storage position wherein the long legs 38 are adjacent and parallel to the longitudinal sections 16 to the use position wherein the short legs 44 are positioned in the ring members 26 and the transverse section 36 is positioned aft and below the ring members 26 to serve as a step for the ladder device.

A flexible strap 47 is provided to help hold the step unit in the storage position.

Advantageously, the transverse section 36 has planking 48 attached thereto to provide a wide tread step. Preferably, the planking 48 is made of wood, but it can be made of metal (not shown). Alternatively, planking may be omitted, in which case the transverse section 36 per se serves as a tubular step.

The saddle brackets 30 have a base 50 from which webs 52 extend. The base has openings 54 therein to admit fasteners to enable the brackets to be mounted on a boat transom. The webs 52 have openings 56 through which pins 58 may be inserted to pivot the platform unit 6 on the brackets 30.

Figure 3:
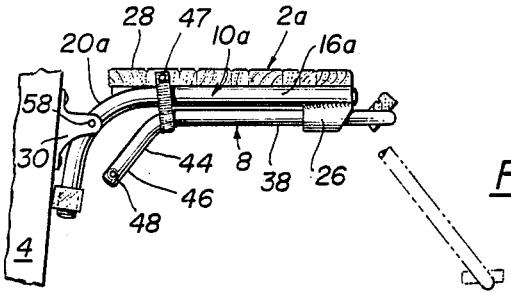
FIG. 3 is lateral view of a second embodiment of a ladder device in accordance with the invention with its step unit raised into the storage position.

The embodiment of the ladder device 2*a* shown in FIG. 3 is very similar to the device 2 of FIG. 1. However, the tubular section 16*a* of device 2*a* is shorter than section 16 of device 2. Also, the elbow 20*a* of device 2*a* has a larger radius that the elbow 20 of device 2 and there is not brace bar 21 in device 2*a*.

Figure 4:
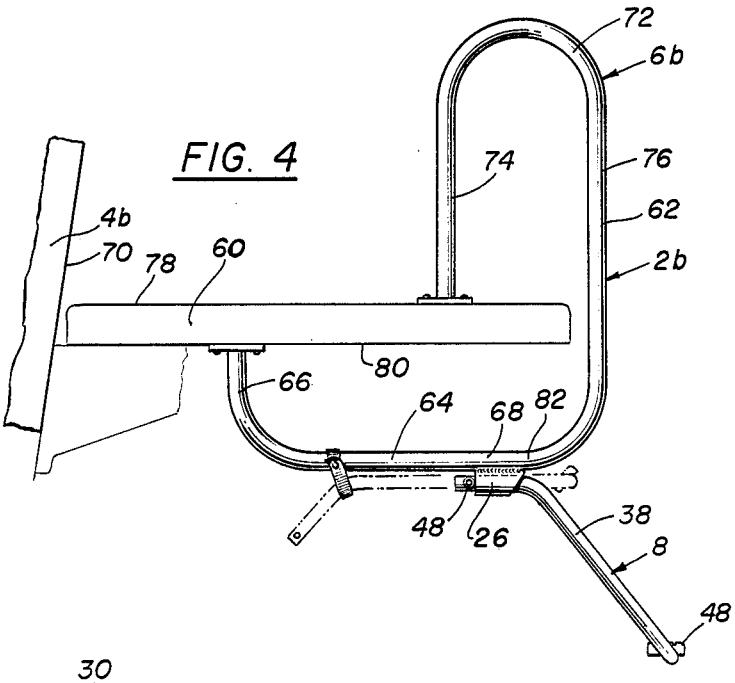
FIG. 4 is lateral view of a third embodiment of a ladder device in accordance with the invention with its step unit lowered into the use position.
Figure 6:
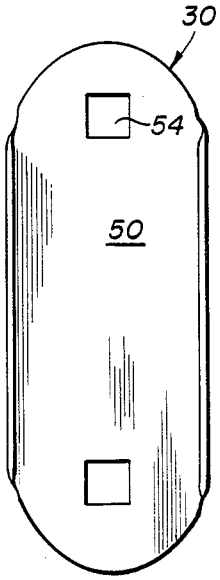
FIG. 6 is an enlarged plan view of a saddle bracket that form part of the ladder devices show in FIGS. 1 & 3.
Figure 5:
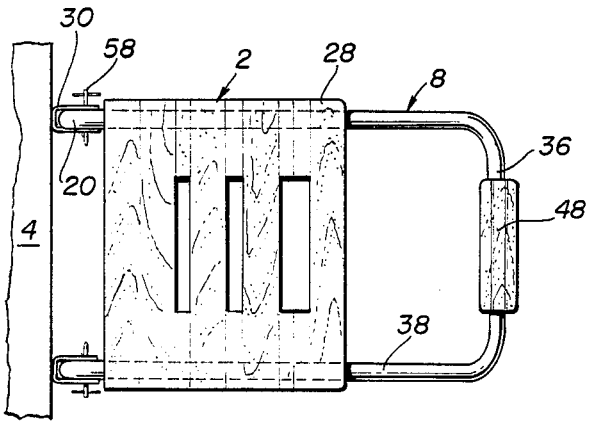
FIG. 5 is a plan view of the ladder device of FIG. 1.
Figure 7:
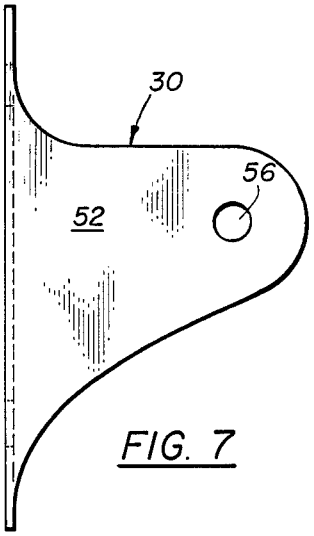
FIG. 7 is an enlarged lateral view of the saddle bracket shown in FIG. 6.

The embodiment of the ladder device 2*b* shown in FIG. 4, which is designed to mount on a stern platform 60 already installed on a boat 4*b*, differs substantially from the devices 2 & 2*a* which include their own platforms.

In the ladder device 2*b*, the platform unit 6*b* comprises a pair of tubular members 62 fastened spaced apart to the stern platform 60. Each tubular member 62 includes an L-shaped portion 64 that depends from the stern platform 60 defined by a short leg section 66 and a longitudinal section 68 that extends substantially horizontally aft of the boat transom 70 and a U-shaped portion 72 integral with the L-shaped portion having a vertical fore section 74 and a vertical aft section 76. The members 62 are fastened to the stern platform 60 so that the vertical fore section 74 extends from the top surface 78 of the stern platform 60 and the short leg section 66 extends from its bottom surface 80.

A ring member 26 depends from each longitudinal section 68 about at its junction 82 with the vertical aft section 76.

Figure 8:
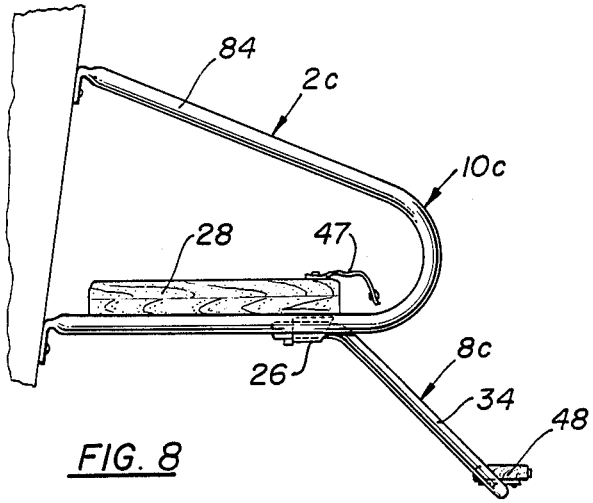
FIG. 8 is lateral view of a fourth embodiment of a ladder device in accordance with the invention with its step unit in the lowered, use position.
Figure 9:
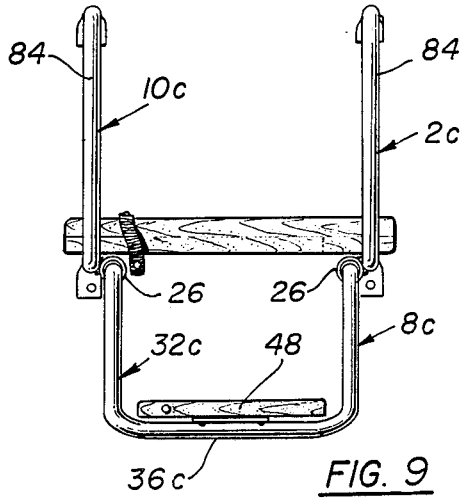
FIG. 9 is an end view of the ladder device of FIG. 8.

The ladder device 2*c* of FIG. 8 is basically like the device 2 except for the tubular units 10*c* which consist of a pair of bracket members 84 to which the ring members 26 and the planking 28 are attached. Also, the U-shaped tubular member 32*c* of the step unit 8c has a transverse section 36*c* that is shorter than section 36 of step units 8.

Figure 10:
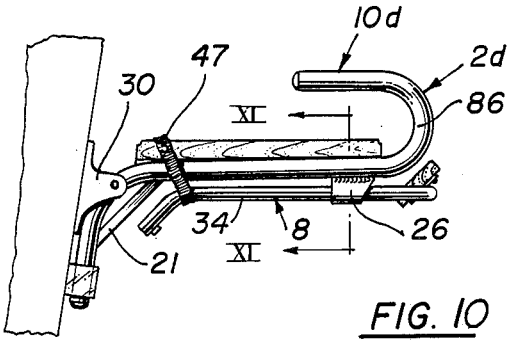
FIG. 10 is lateral view of a fifth embodiment of a ladder device in accordance with the invention with its step unit in the raised, storage position.
Figure 11:
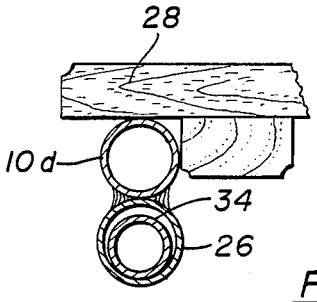
FIG. 11 is a sectional view taken on the line XI—XI of FIG. 10.

The ladder device 2*d* of FIG. 10 is basically like the device 2*a* except for the tubular units 10*d* which differ from the units 10*a* of device 2a by having a corner brace 21 and a U-shaped end 86.

Figure 12:
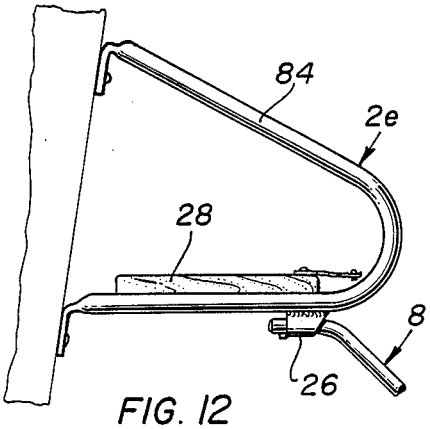
FIG. 12 is lateral view of a sixth embodiment of a ladder device in accordance with the invention with its step unit in the lowered, use position.
Figure 13:
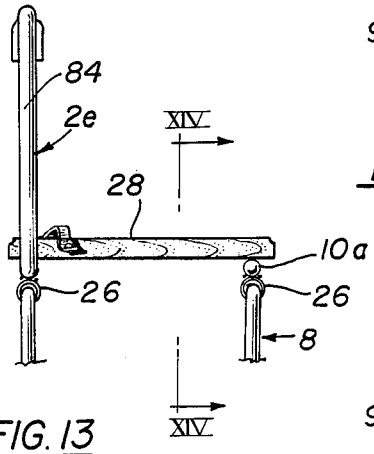
FIG. 13 is an end view of the ladder device of FIG. 12.
Figure 14:
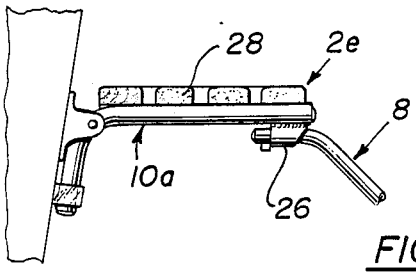
FIG. 14 is a sectional view taken on the line XVI—XVI of FIG. 13.

The ladder device 2*e* of FIGS. 12–14 is basically like the device 2*c* except it has only one bracket member 84 while the other side of its planking 28 is supported by a tubular unit 10*a*. The ladder device 2*e* is particularly suitable for use with narrow beam, outboard motorboats.

Figure 15:
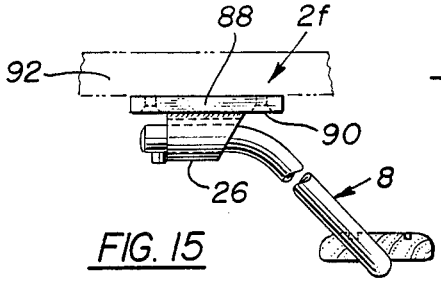
FIG. 15 is a lateral, fragmentary view of a seventh embodiment of a ladder device of the invention.

The ladder device *2f* shown in FIG. 15 is designed to retrofit platforms already installed on a boat either to replace an existing step unit or to provide a ladder feature to a platform which lacks such a feature. The device *2f* includes a step unit 8 and ring member 26 which is attached to a plate member 88 having a pair of holes 90 therein to admit fasteners (not shown) for attaching the device *2f* to a boat platform 92 shown in phantom line.

Figure 17:
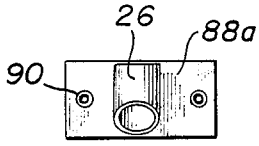
FIG. 17 is a plan view of a variation of the mount unit shown in FIG. 16.
Figure 16:
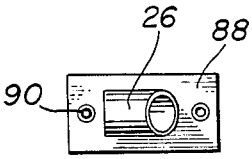
FIG. 16 is a plan view of a mount unit of the seventh embodiment.

The modified plate member 88*a* shown in FIG. 17 has its holes aligned normally to the longitudinal axis of the ring member 26 in contrast to the parallel alignment of holes and axis in the plate member 88.

The step units 8 of device 2 etc. are basically the same in all the devices of the invention except for minor differences in step width as explained relative to device *2c*. This step unit concept makes it possible to provide boats with ladder devices in which the step unit may be moved between a use position with a step thereof immersed in the water in which the boat floats and a storage position where said step is stored out of said water in a manner requiring very little space. Further, the step in the use position extends aft of the platform unit and permits a person to climb out of the water and onto the platform unit without the step making any appreciable movement relative to the platform unit during such climb.

The embodiments of the invention in which an exclusive property or privilege is claimed are defined as follows:

1. In a ladder device for the transom of a boat having a platform unit and a step unit that may be moved between a use position with a step thereof immersed in the water in which the boat floats and a storage position where said step is located out of said water, which step in said use position extends aft of said platform unit and permits a person to climb out of said water and onto said platform unit without said step making any appreciable movement relative to said platform unit during such climb, the improvement wherein:

said platform unit comprises:

a pair of parallel, longitudinal sections that in said use position of said ladder device extend substantially horizontally aft of said transom and a ring member that depends from each said longitudinal section, and said step unit comprises:

a U-shaped tubular member defined by two parallel side sections joined integrally to a transverse section, said side sections each including a long leg attached at one end to said transverse section and attached at the other end to a short leg leaving one end of said short leg unattached, the longitudinal axis of said short leg at an obtuse angle to the longitudinal axis of said long leg, and stop means on said unattached end of said short leg, said U-shaped tubular member being formed from tubing having an outside diameter slightly less than the inside diameter of said ring member whereby said side sections of said U-shaped tubular member may be moved through said ring member to move said step unit from said storage position wherein said long legs are adjacent and parallel to said longitudinal sections to said use position wherein said short legs are positioned in said ring members and said transverse section is positioned aft and below said ring members to serve as a step for said ladder device, said stop means preventing said short legs from exiting said ring members.

2. The ladder device of claim 1 wherein said longitudinal members are held spaced apart by planking that is fixed thereto.

3. The ladder device of claim 2 wherein said planking is made of wood.

4. The ladder device of claim 2 wherein said planking is made of metal.

5. The ladder device of claim 1 wherein said stop means are lugs that extend from said unattached ends of said short legs.

6. The ladder device of claim 1 wherein said longitudinal members a plates to which said ring members are welded.

7. In a ladder device for the transom of a boat having a platform unit and a step unit that may be moved between a use position with a step thereof immersed in the water in which the boat floats and a storage position where said step is located out of said water, which step in said use position extends aft of said platform unit and permits a person to climb out of said water and onto said platform unit without said step making any appreciable movement relative to said platform unit during such climb, the improvement wherein:

said plaform unit comprises:

a pair of spaced apart, L-shaped tubular members having an inboard section and a longitudinal section, said inboard section being defined by a length of tubing attached at one end to said longitudinal section by a substantially right angle elbow, said longitudinal section being defined by a length of tubing having a first end attached to said inboard section and second unattached end, a ring member that depends from each said longitudinal section at said unattached end thereof, and planking attached to said longitudinal section of each said tubular member holding them spaced apart and with said inboard sections thereof extending away from said planking, and said step unit comprises:

a U-shaped tubular member defined by two parallel side sections joined integrally to a transverse section, said side sections each including a long leg attached at one end to said transverse section and attached at the other end to a short leg leaving one end of said short leg unattached, the longitudinal axis of said short leg being at an obtuse angle to the longitudinal axis of said long end, and lugs that extend normally from said unattached end of each said short leg, said U-shaped tubular member being formed from tubing having an outside diameter slightly less than the inside diameter of said ring member whereby said side sections of said U-shaped tubular member may be moved through said ring member to move said step unit from said storage position wherein said long legs are adjacent and parallel to said longitudinal sections to said use position wherein said short legs are positioned by said lugs in said ring members and said transverse section is positioned aft and below said ring members to serve as a step for said ladder device.

8. The ladder device of claim 7 wherein said platform unit includes a strap to assist in holding said step unit in its storage position.

9. The ladder device of claim 7 wherein said transverse section has planking attached thereto to provide a wide tread step.

10. The ladder device of claim 7 that includes a pair of saddle brackets on which said platform unit is pivoted.

11. The ladder device of claim 10 wherein said platform is pivoted to said brackets by pins that extend through said elbows.

12. A ladder device for the transom of a boat having a stern platform thereon which comprises a platform unit and a step unit that may be moved between a use position with a step thereof immersed in the water in which the boat floats and a storage position where said step is located out of said water, which step in said use position extends aft of said stern platform and permits a person to climb out of said water and onto said stern platform without said step making any appreciable movement relative to said stern platform during such climb wherein:

said platform unit comprises:

a pair of tubular members fastened spaced apart to said stern platform, each of said members including:

an L-shaped portion that depends from said stern platform defined by a short leg section and a longitudinal section that extends substantially horizontally aft of said transom and a U-shaped portion integral with said L-shaped portion having a vertical fore section and a vertical aft section, said members being fastened to said stern platform so that said vertical fore section extends from the top surface of said stern platform and said short leg section extends from the bottom surface of said stern platform, and a ring member that depends from each said longitudinal section about at its junction with said vertical aft section of said U-shaped portion, said step unit comprises:

a U-shaped tubular member defined by two parallel side sections joined integrally to a transverse section, said side sections each including a long leg attached at one end to said transverse section and attached at the other end to a short leg leaving one end of said short leg unattached, the longitudinal axis of said short leg being at an obtuse angle to the longitudinal axis of said long leg, and lugs that extend normally from said unattached end of said short leg, said U-shaped tubular member being formed from tubing having an outside diameter slightly less than the inside diameter of said ring member whereby said side sections of said U-shaped tubular member may be moved through said ring member to move said step unit from said storage position wherein said long legs are adjacent and parallel to said longitudinal sections to said use position wherein said short legs are positioned by said lugs in said ring members and said transverse section is positioned aft and below said ring members to serve as a step for said ladder device.

13. In a ladder device for the transom of a boat having a platform unit and a step unit that may be moved between a use position with a step thereof immersed in the water in which the boat floats and a storage position where said step is located out of said water, which step in said use position extends aft of said platform unit and permits a person to climb out of said water and onto said platform unit without said step making any appreciable movement relative to said platform unit during such climb, the improvement wherein:

said platform unit comprises:

a pair of parallel, longitudinal sections that in said use position of said ladder device extend substantially horizontally aft of said transom and a ring member that depends from each said longitudinal section, and said step unit comprises:

two parallel tubular side sections each including a long leg attached at one end to a short leg leaving one end of said short leg unattached, the longitudinal axis of said short leg being at an obtuse angle to the longitudinal axis of said long leg, stop means on said unattached end of each said short leg, and a step supported by said side sections, said side sections being formed from tubing having an outside diameter slightly less than the inside diameter of said ring member whereby said side sections of said side sections may be moved through said ring member to move said step unit from said storage position wherein said long legs are adjacent and parallel to said longitudinal sections to said use position wherein said short legs are positioned in said ring members and said step is positioned aft and below said ring members, said stop means preventing said short legs from exiting said ring members.

14. The ladder device of claim 13 wherein said step is flat.

15. The ladder device of claim 14 wherein said step is made of wood.

* * * * *